US005649372A

United States Patent [19]

Souza

[11] Patent Number: 5,649,372

[45] Date of Patent: Jul. 22, 1997

[54] DRYING CYCLE CONTROLLER FOR CONTROLLING DRYING AS A FUNCTION OF HUMIDITY AND TEMPERATURE

[75] Inventor: William J. Souza, Fall River, Mass.

[73] Assignee: American Dryer Corporation, Fall River, Mass.

[21] Appl. No.: 616,004

[22] Filed: Mar. 14, 1996

[51] Int. Cl.[6] ..... F26B 3/02

[52] U.S. Cl. ..... 34/491; 34/495; 34/535; 34/496

[58] Field of Search ..... 34/474, 475, 495, 34/496, 497, 535, 557

[56] References Cited

U.S. PATENT DOCUMENTS

| | | | |
|---|---|---|---|
| 1,997,826 | 4/1935 | Krick | 34/475 |
| 4,485,566 | 12/1984 | Vivares | 34/44 |
| 4,649,654 | 3/1987 | Hikino et al. . | |
| 4,733,479 | 3/1988 | Kaji et al. . | |
| 4,738,034 | 4/1988 | Muramatsu et al. | 34/48 |
| 5,050,313 | 9/1991 | Wakaeya et al. . | |
| 5,161,314 | 11/1992 | Souza | 34/48 |
| 5,172,490 | 12/1992 | Tatsumi et al. | 34/54 |
| 5,347,727 | 9/1994 | Kim . | |

*Primary Examiner*—Henry A. Bennett
*Assistant Examiner*—Dinnatia Doster
*Attorney, Agent, or Firm*—Pollock, Vande Sande & Priddy

[57] ABSTRACT

A drying cycle controller for a garment dryer. The drying cycle is controlled to have a decreasing temperature and humidity profile which avoids the removal of moisture at a rate which will cause shrinkage and wrinkling of the garment. The drying cycle temperature profile is controlled by continuously sensing the humidity within the drying chamber, and decreasing the drying temperature each time the relative humidity drops to one of a plurality of set points. Once the humidity has reached the final set point, the dryer enters a cool down cycle for a predetermined cool down time.

16 Claims, 7 Drawing Sheets

DRYING CYCLE CONTROLLER FOR CONTROLLING DRYING AS A FUNCTION OF HUMIDITY AND TEMPERATURE

BACKGROUND OF THE INVENTION

The present invention relates to a dryer for drying delicate garments which are subject to shrinkage. Specifically a drying cycle controller is disclosed for a dryer which will dry the garment in an environment of controlled temperature and humidity.

Various devices have been proposed to control the drying of garments so that minimum wrinklage, or shrinkage of the garments occur. Included among such devices is a device described in U.S. Pat. No. 5,161,314 for controlling the drying of tumbled material. The device of the foregoing patent reduces wrinklage of the garments by controlling the drying temperature profile in the tumbling chamber during a cool down cycle which follows a drying cycle. As disclosed in the aforesaid patent, the wrinklage of the dried material is reduced if a preferred temperature versus time profile is maintained during a cool down cycle rather than permitting the temperature to decrease at a naturally occurring exponential rate.

Although the foregoing device reduces wrinklage, there are many garments which are dry cleaned only as they are prone to excessive shrinkage if moisture is removed from the garment too rapidly. The rate of water removed varies for different types of garments and is highly dependent upon the material type as well as the load size.

The rate of moisture removal and the shrinkage and wrinklage which occurs in dry clean only garments depends upon the size of the load being dried, the material type, and the relative humidity of the external environment. Unless the drying environment is controlled to take into account each of these factors, the rate of moisture removal can not be adequately controlled to avoid wrinklage and/or shrinkage of the garment.

SUMMARY OF THE INVENTION

It is object of this invention to control the rate of drying of material being tumbled in a garment dryer.

It is a more specific object of this invention to provide a drying cycle controller for controlling the temperature and humidity within a drying chamber of a garment dryer during a drying cycle.

These and other objects of the invention are provided by a drying cycle controller which includes a processor connected to a temperature sensor and a humidity sensor for deriving a burner control signal. The control signal establishes a desirable drying chamber temperature versus time profile which accurately controls the rate at which moisture is removed from the tumbled material.

In a preferred embodiment of the invention, the processor is programmed to establish an initial drying temperature for materials being tumbled in a drying chamber. Once the initial drying temperature is established, the tumbled materials are permitted to dry until a preset reduction in relative humidity within the drying chamber is achieved. The drying temperature is then reduced step wise to a new drying temperature. Additional step wise decreases in the drying temperature may be effected each time a new predetermined level of relative humidity is achieved within the drying chamber. The rate of moisture removal can therefore be accurately controlled to reduce wrinkling and/or shrinking of the material.

A set of tables is provided which includes a series of drying temperature settings, and corresponding relative humidity setting representing drying stages of different drying cycles for different garment types, as well as the size of a load of material being tumbled. The user may select a drying cycle for the controller based on these considerations.

DESCRIPTION OF THE PREFERRED EMBODIMENT

Figure 1:
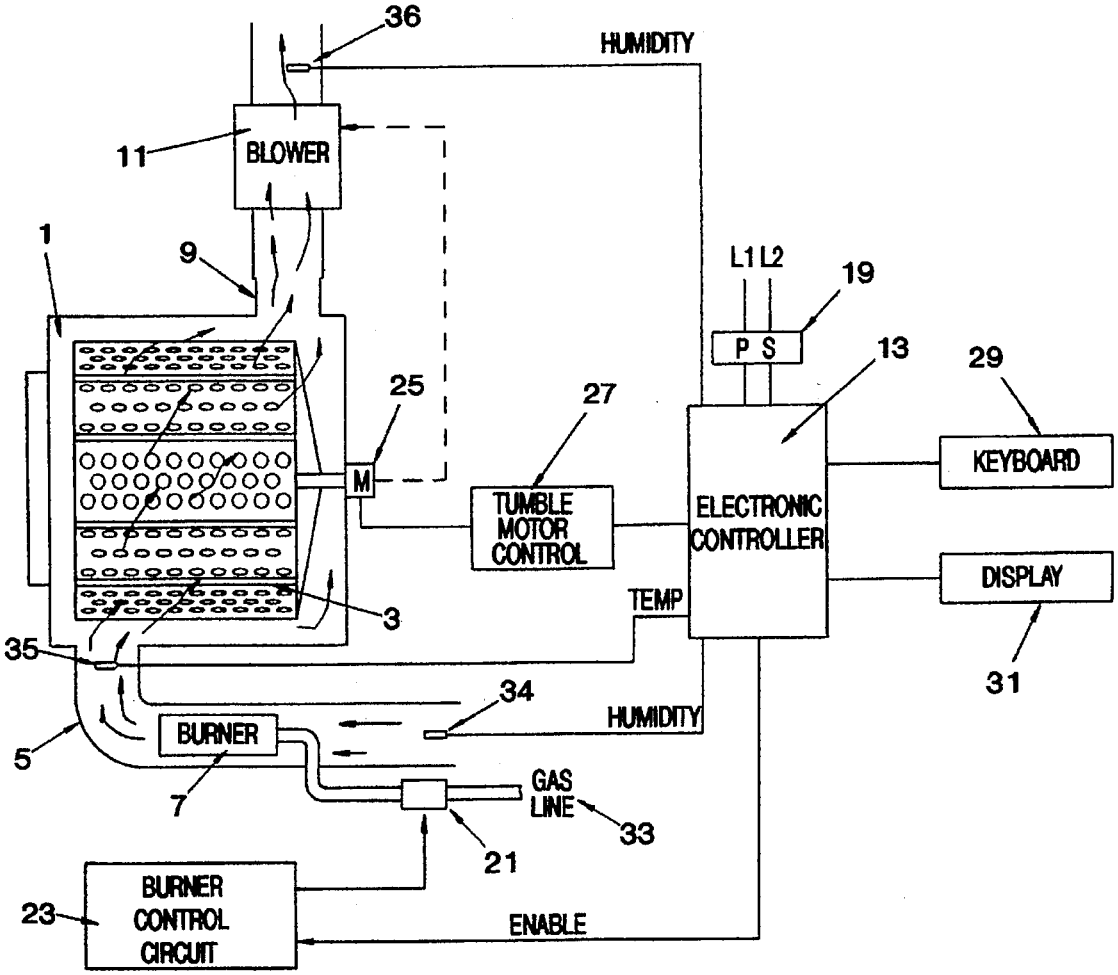
FIG. 1 illustrates a garment dryer having a controller for controlling the rate of moisture removal from garments being dried.

Referring to FIG. 1 there is shown an implementation of the invention in accordance with the preferred embodiment. The invention is directed to a drying apparatus having a drying chamber 1, which includes a rotating perforated drum 3. Material to be dried are loaded into the perforated drum 3, and rotated by a motor 25 to tumble the material during drying.

Hot drying air is introduced into the drying chamber 1 by an inlet 5 connected to a burner 7. A blower 11 coupled to motor 25 draws ambient air into the inlet 5, where it is heated by a burner 7 before entering the drying chamber. Control over the tumble motor 25, and blower 11 results from the tumble motor control 27 being enabled during a drying cycle by electronic controller 13. The burner 7 is shown as a gas operated burner, receiving a source of fuel through gas line 33 under control of a solenoid valve 21.

Control over the drying temperature is achieved with a burner control circuit 23 similar to the apparatus described in U.S. Pat. Nos. 5,161,314, and 4,827,627. A closed loop control system comprising a temperature sensor 35, electronic controller 13, and burner control circuit 23, maintains the inlet 5 air temperature substantially constant.

A first humidity sensor 36 is located in the exhaust outlet 9 of the drying chamber 1, and a second humidity sensor 34 is located at the inlet of burner 7, for sensing the room environment relative humidity.

The system of FIG. 1 includes a keyboard 29 and display 31. The keyboard 29 permits the entry of various parameters for controlling drying, as well as the programming of the electronic controller 13 to execute the steps comprising a drying cycle as will be described later herein. A power supply 19 is connected to the line voltage for providing operating voltage to electronic controller 13.

Figure 2:
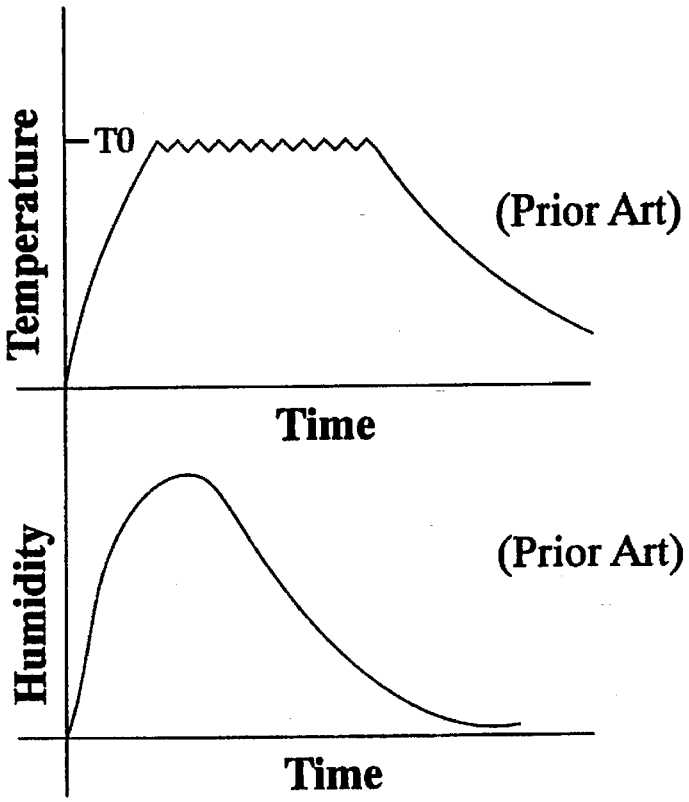
FIG. 2 illustrates the conventional temperature and humidity profile of the drying chamber environment during a prior art drying cycle.

The control over the drying cycle will be explained with respect to FIGS. 2 and 3. FIG. 2 represents temperature and humidity conditions within the drying chamber 1 in accordance the prior art drying cycle. In the prior art an initial drying temperature is reached throughout the drying cycle and is maintained at a constant temperature T0. As shown in FIG. 2 the humidity within the drying chamber 1 undergoes a rapid decrease, while drying at a constant temperature, producing a rapid removal of moisture inducing shrinkage and/or wrinklage to the garments being dried.

Figure 3:
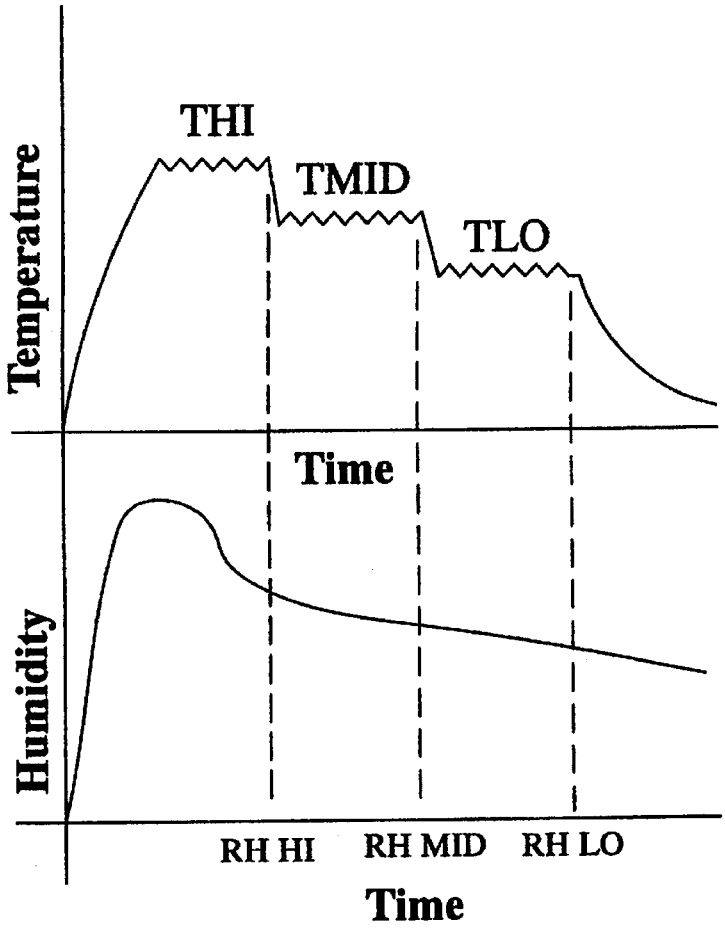
FIG. 3 illustrates the relationship between temperature and humidity of a drying chamber during a drying process in accordance with one embodiment of the invention.
Figure 4:
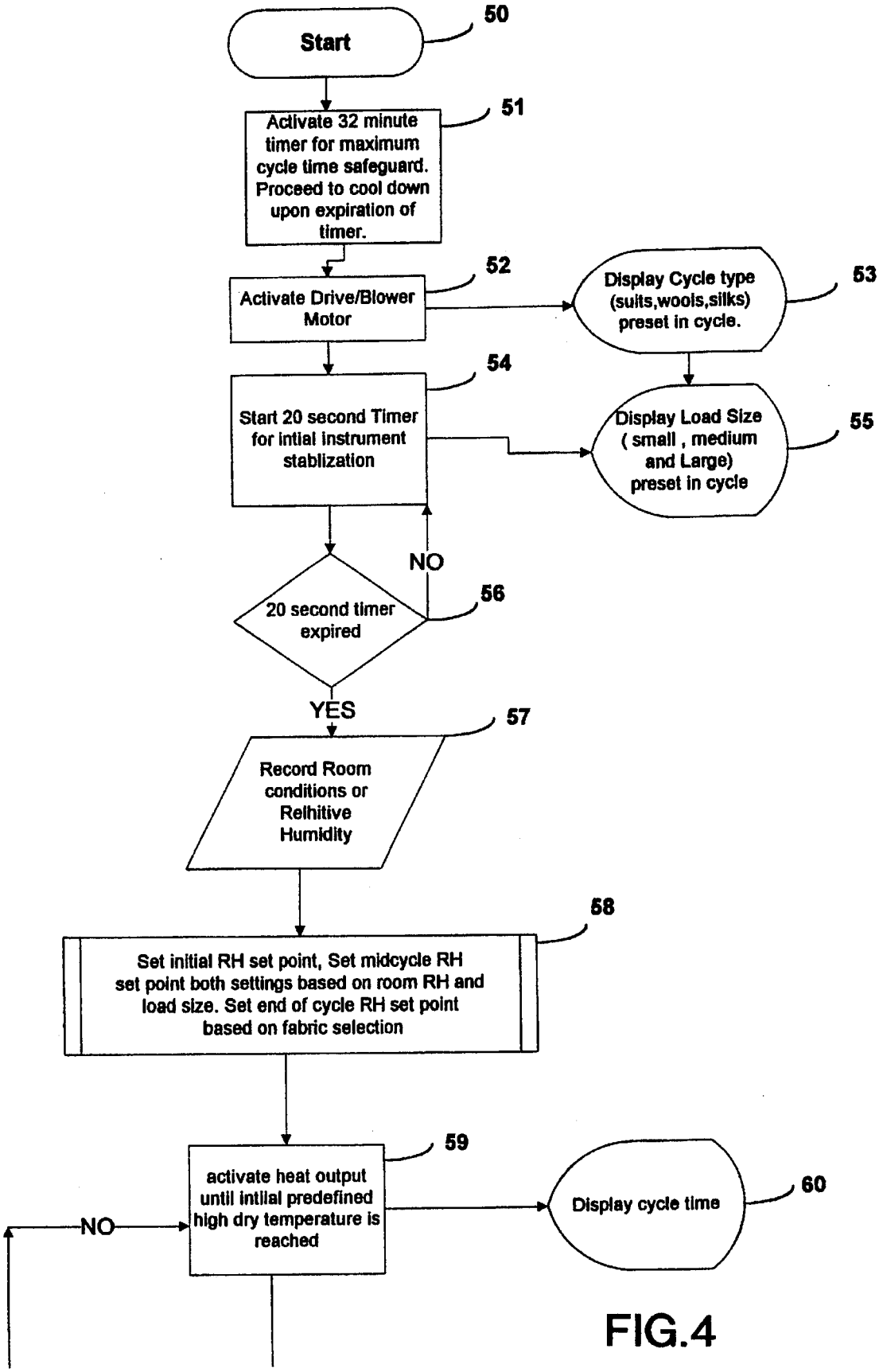
FIG. 4 is a flow chart illustrating the initial steps carried out by the electronic controller to enter an initial drying phase.
Figure 5:
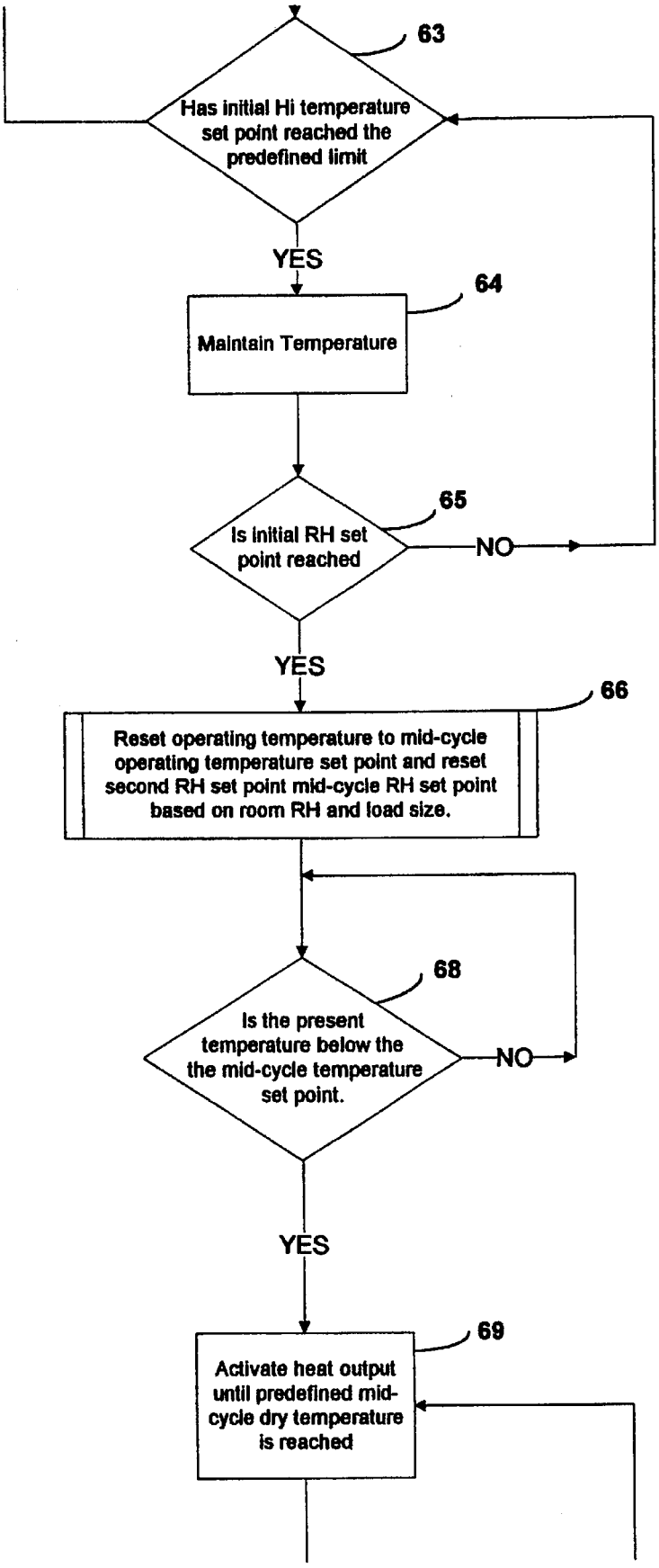
FIG. 5 illustrates the steps executed by the electronic controller to generate a preferred humidity versus temperature profile during an initial drying phase.
Figure 6:
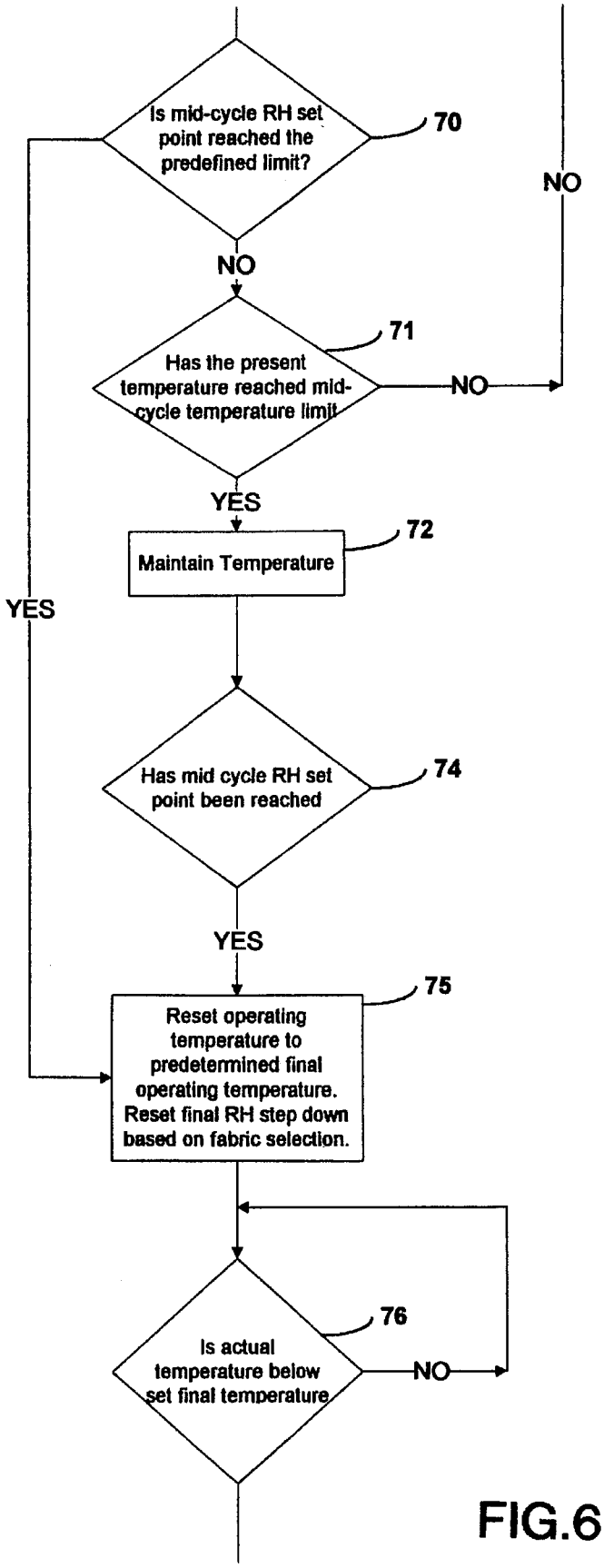
FIG. 6 illustrates the steps executed by the electronic controller during a mid-cycle drying phase.
Figure 7:
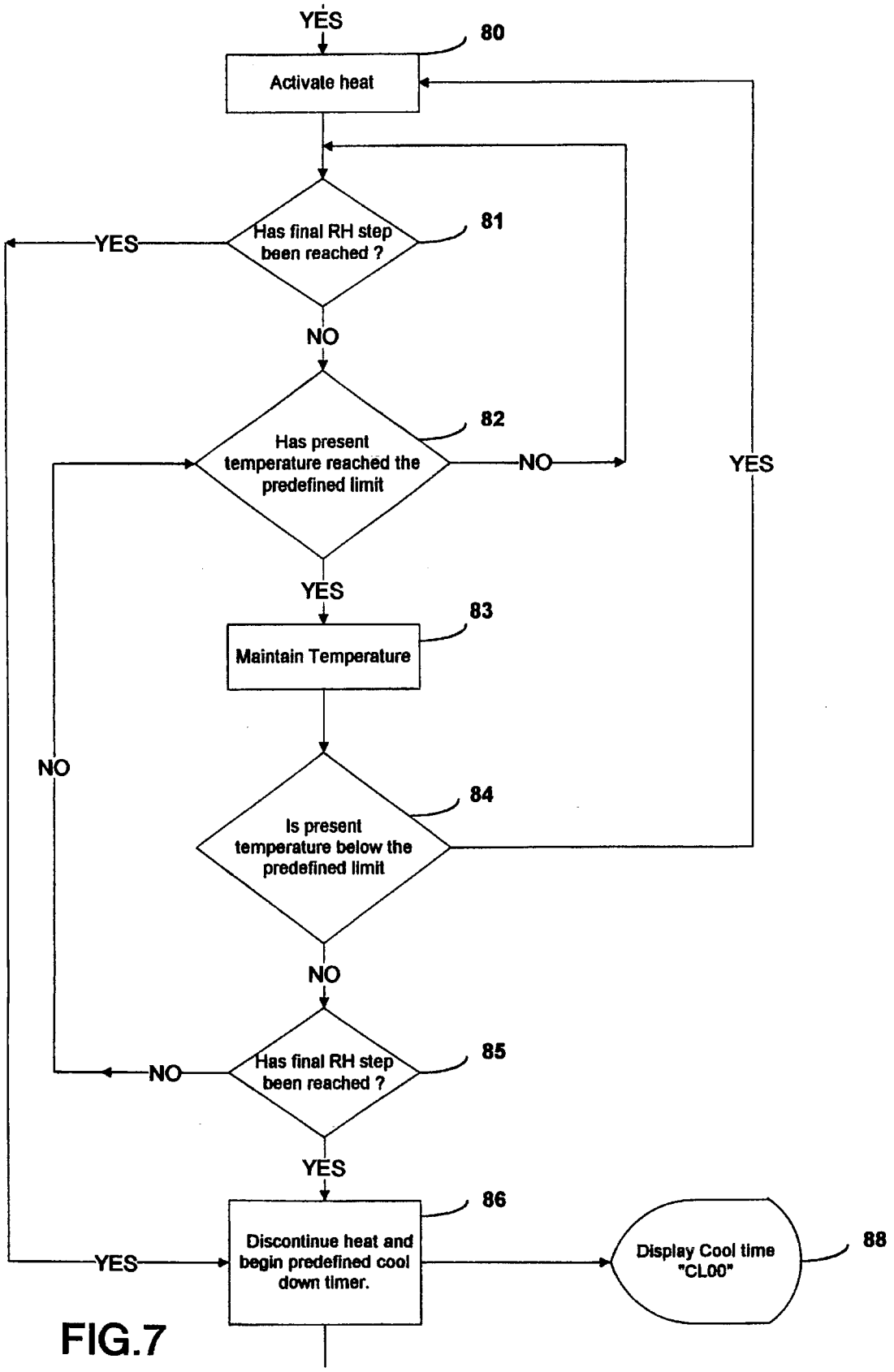
FIG. 7 is a flow chart illustrating the steps performed by the electronic controller 13 during the end phase of the drying cycle.
Figure 8:
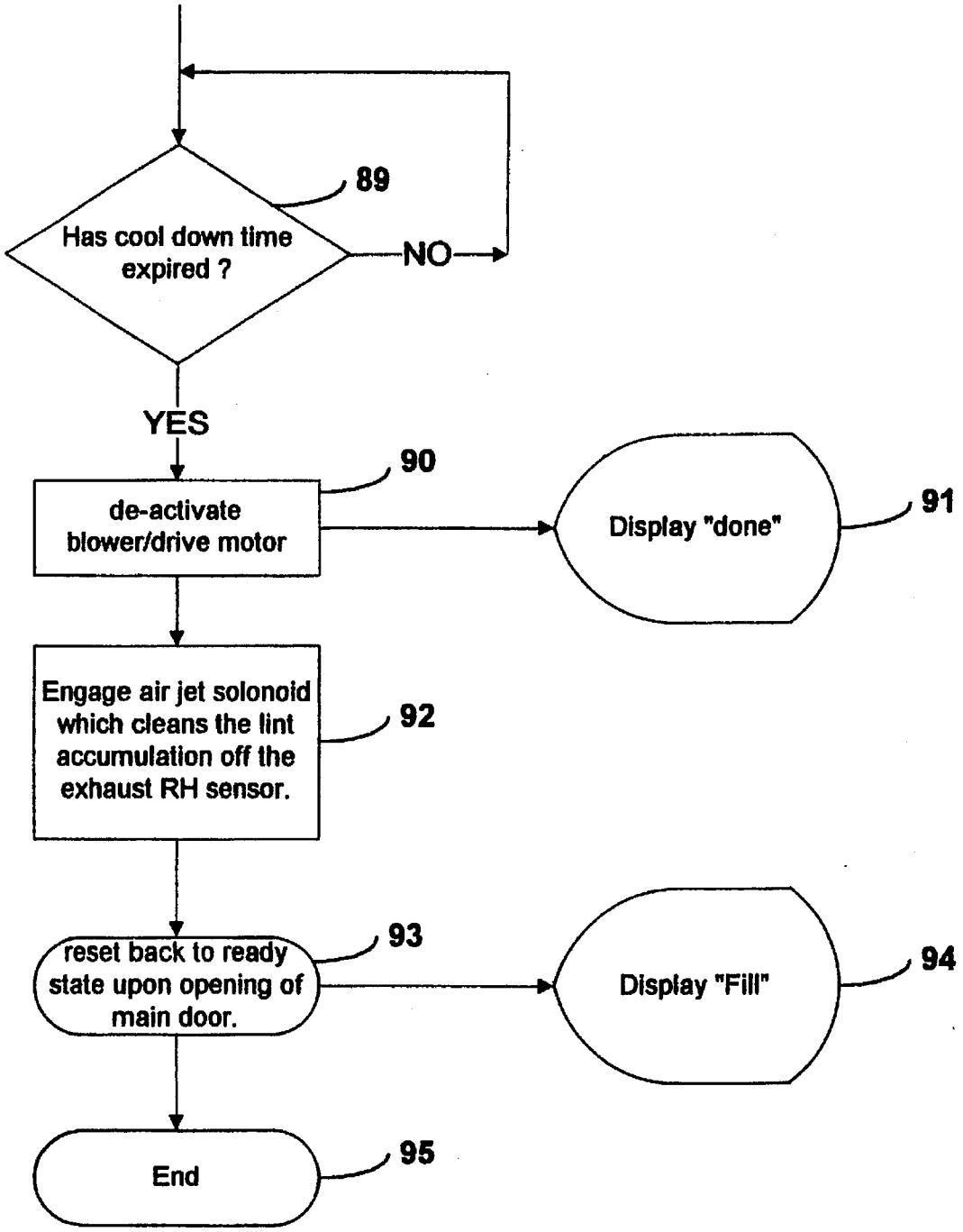
FIG. 8 is a flow chart illustrating the conclusion of a cool down cycle.

FIG. 3 represents a temperature and humidity profile for the drying chamber 11 in accordance with the preferred embodiment of the invention. The temperature profile is shown as a stepped temperature profile, which increases the drying time, and avoids a steep drop in the relative humidity within the drying chamber 1, and the corresponding rapid reduction in moisture which occurred in the drying cycle depicted in FIG. 2. The three temperatures constituting a drying cycle comprise a high temperature, mid-cycle temperature, and end cycle temperature.

In order to achieve the temperature and humidity profile during the drying cycle in accordance with FIG. 3, the tumbled garments are dried at three separate temperatures, with the initial drying temperature being the highest. Control over drying temperature is effected based on the sensed humidity conditions within the drying chamber. The drying temperature is lowered from an initial high temperature setting to a midcycle temperature setting when the humidity within the drying chamber i is equal to a humidity level representing a temperature switch point. As shown in FIG. 3, there are three humidity conditions, R HI, RH MID, and/or RH LOW which result in the drying temperature being changed from T HI to T MID, and then to T LO. The last relative humidity condition RH LO results in the burner being disabled ending the drying cycle.

In accordance with a preferred embodiment, Table 1 shows for different materials being dried, i.e., a suit or a coat, and for three different load sizes, three temperatures T HI, T MID and T LO as well as relative humidity levels R HI, R MID and R LO for defining drying conditions for the material in a controlled drying cycle.

TABLE 1

| CYCLE | LOAD | TEMPERATURES | | | RELATIVE HUMIDITY | | |
|---|---|---|---|---|---|---|---|
| TYPE | SIZE | T HI | T MID | T LO | R HI | R MID | R LO |
| SUIT | LARGE | 160 | 145 | 130 | 28% | 23% | 22% |
| | MEDIUM | 160 | 145 | 130 | 25% | 22% | 21% |
| | SMALL | 160 | 145 | 130 | 22% | 18% | 17% |
| COAT | LARGE | 160 | 145 | 135 | 28% | 23% | 21% |
| | MEDIUM | 160 | 145 | 135 | 25% | 21% | 19% |
| | SMALL | 160 | 145 | 135 | 22% | 18% | 16% |

Table 1 illustrates that drying is effected by the size of the load as well as the type of garment being dried. The values in the table are also dependent on the relative humidity of the room containing the dryer. Table 1 is a fairly typical representation of drying cycle conditions when room relative humidity is 45%.

Table 2 illustrates the effect of environmental relative humidity on each of the drying chamber relative humidity steps R HI and R MID of Table 1 for a given load size. Each of the relative humidity settings of Table 1 can be weighted, in accordance with the load size as follows: Large=100%, Medium=95%, and Small=90%.

TABLE 2

| ROOM R.H. | (R_HI) 1ST R.H. STEP | (R MID) 2ND R.H. STEP |
|---|---|---|
| 0 | (ERROR) | |
| 1–3% | (ROOM)-1 | (R_HI)-1 |
| 4–8% | (ROOM)-1 | (R_HI)-1 |
| 9–13% | −3 | −2 |
| 14–18% | −5 | −2 |
| 19–23% | −6 | −3 |
| 24–28% | −7 | −3 |
| 29–33% | −9 | −4 |
| 34–38% | −11 | −4 |
| 39–43% | −13 | −5 |
| 44–48% | −17 | −5 |
| 49–53% | −19 | −6 |
| 54–58% | −21 | −6 |
| 59–63% | −24 | −7 |
| 64–68% | −26 | −7 |
| 69–73% | −28 | −8 |
| 74–78% | −30 | −8 |
| 79–83% | −32 | −9 |
| 84–88% | −34 | −9 |
| 89–93% | −36 | −10 |
| 94–98% | −38 | −10 |
| 99% | −40 | −11 |
| 100% | (ERROR | |

FIGS. 4, 5, 6, 7 and 8 illustrate more completely the programming steps executed by electronic controller 13 to derive a drying cycle in accordance with the preferred embodiment of the present invention. The flow chart represented in FIGS. 4, 5, 6, 7 and 8 illustrates a control sequence for the burner 7 of FIG. 1 to generate a decreasing temperature profile from a sensed humidity condition within drying chamber 1.

The program starts at 50, when a load of material to be dried is loaded in the tumbler 3 of the drying chamber 1. The start command is entered through the keyboard 29 of the electronic controller. A 32 minute timer is activated in step 51 as a maximum time safeguard against over drying. In the event the electronic controller 13 has not completed the drying cycle within 32 minutes, the drying cycle will be terminated. The blower 11 and motor 25 are activated in step 52 to begin the drying process.

The display 31 displays a material type entered through keyboard 29 being dried within the drying chamber 1. Further, the load size (also entered through keyboard 29) which as noted previously is a parameter in determining the humidity level for stepping down the drying temperatures, is also displayed alternatively with the material type.

A stabilization period is entered in step 54, by initiating a second timeout period for 20 seconds. During the 20 second period, the sensor conditions are permitted to settle. Following the 20 second timeout period, decision block 56 will enable the electronic controller 13 to measure and store the relative humidity sensed by sensor 34.

Having now determined the relative humidity, it is possible to determine the first and second temperature switch points from a table containing data such as is shown in Tables 1 and 2. The initial RH switch point and mid-cycle RH switch point are determined based on the room relative humidity and the load size being dried. The end of the cycle switch point R LO is obtained from Table 1 based on the fabric type and is substantially invariable to load size.

With the conditions set for defining the drying cycle, the burner controller circuit 23 is activated in step 59, and the temperature of the drying chamber 1 is increased to the high temperature value T HI. The elapsed time after reaching T HI is continuously displayed on display 31. Once the initial high temperature T HI has been reached within drying chamber 11 as determined in step 63, the temperature is maintained by the electronic controller 13 as represented in step 64. As set forth in the previous patents, the temperature is maintained constant by the feedback loop constituting controller 13, temperature sensor 15 and burner 7.

During the time the drying temperature is at the initial high temperature level T HI, the relative humidity monitored by the sensor 36 is continuously measured. When the initial relative humidity R HI set point is reached in 65, a change in drying temperature occurs.

Electronic controller 13 in accordance with step 66 will let the drying temperature decrease to the new operating temperature T MID for the drying chamber 1. Decision block 68 determines whether the temperature is below the new, mid-cycle temperature set point T MID in decision block 68. The electronic controller 13 will maintain the temperature as sensed by temperature sensor 35 to the selected setting T MID in step 69.

The relative humidity during the mid-cycle temperature setting T MID is continuously measured, and when the mid-cycle relative humidity RH MID is detected in step 70, the operating drying chamber 1 temperature will then be reset to the final end of drying cycle temperature setting T LO. The transition from mid-cycle temperature setting to T MID end of cycle temperature T LO occurs at any time the relative humidity setting as determined in step 70 reaches the predefined limit. Steps 71 and 72 continuously measure the drying temperature and maintain the drying temperature at T MID until RH LO has been detected in the drying chamber.

Once the mid-cycle relative humidity has been obtained, as determined in decision 74, the operating temperature is set to the final operating temperature T LO in step 75. Decision blocks 76 through 80 will determine whether or not the final temperature has been reached, and activate the heat in step 80 as necessary to reach the final temperature.

Once the final relative humidity within the drying chamber 1 has been found to equal the final relative humidity RH LO in decision block 81, heating is discontinued in step 86 and a cool down time cycle for the dryer is entered. Until the final end of cycle relative humidity setting has been detected, the temperature is continuously monitored in step 82 and maintained by step 83 at the final temperature T LO setting. Decision block 84 participates in the process of activating the heat in step 80, whenever the temperature falls below the end of cycle final temperature T LO. Decision block 85 determines, after maintaining the temperature of the drying chamber at the final end of drying cycle temperature for a period of time, when the relative humidity within the drying chamber has reached the final end of cycle relative humidity RH LO set point.

The cool down cycle is entered in step 86, and the display 31 will indicate the cool down time 88. The cool down cycle can be set for a specific timed period, which is constantly measured. Once the cool down time has expired as determined in decision block 89, the motor 25 is deenergized, as well as blower 11 to step 90 by the electronic controller 13. The display 31 indicates that drying is done in 91.

An air jet solenoid, is associated with the humidity sensor 36. At the completion of a drying and cool down cycle, the air jet solenoid may be activated by the electronic controller 13 to clean any lint accumulation occurring on the humidity sensor 36 in step 92.

Once the door to the drying chamber 1 is opened, the electronic controller 13 is reset back to an initial condition in step 93. A fill indication is displayed on display 31 indicating the dryer is ready for an additional load. The process is therefore completed 95.

Thus there has been described with respect to one embodiment of the invention a complete programming sequence for an electronic controller for providing a drying cycle which minimizes shrinkage and wrinklage of delicate garments. Those skilled in the art will recognize yet other embodiments described more particularly by the claims which follow.

What is claimed is:

1. A drying cycle controller for a garment dryer to control the temperature within a drying chamber comprising:

a temperature sensor for monitoring the temperature within said drying chamber;

a humidity sensor for monitoring the relative humidity within said drying chamber;

means for comparing the temperature within said drying chamber with a first temperature representing the temperature at the beginning of a drying cycle, and for comparing the relative humidity within said drying cycle with a first relative humidity value representing the relative humidity at the beginning of said drying cycle; and means for generating a signal to enable heating of said drying chamber to establish said beginning drying cycle temperature, and for generating a second signal to enable heating of said drying chamber to establish a subsequent drying temperature when said relative humidity of said drying chamber equals said beginning drying cycle relative humidity.

2. The drying cycle controller of claim 1 wherein said drying cycle controller generates a signal to enable heating to establish a third temperature in said drying chamber when said means for comparing indicates that said drying chamber relative humidity has reached a second lower relative humidity.

3. The drying cycle controller of claim 2 wherein said drying cycle controller disables generation of said signal to establish said third temperature when said means for comparing indicates that said drying chamber relative humidity has reached a third, end of drying cycle, relative humidity.

4. The drying cycle controller of claim 3 wherein a cool down interval for said drying chamber is established when said means for comparing indicates that said drying chamber relative humidity is below said third, end of drying cycle, relative humidity.

5. The drying cycle controller of claim 1 further comprising a second humidity sensor outside of said drying chamber for determining an environmental relative humidity, and means for modifying said first relative humidity value in accordance with said environmental relative humidity.

6. In a garment dryer of the type having drying chamber with a rotating drying tumbler for tumbling a garment during a drying cycle, a heat source for supplying drying air to said drying chamber, a circuit for controlling drying of said garment which reduces shrinkage of said garment comprising:

a humidity sensor for measuring the humidity in said drying chamber;

a temperature sensor for measuring the drying temperature in said drying chamber;

control means connected to said heat source for turning said heat source on and off in response to a control signal; and an electronic controller connected to receive signals from said temperature sensor and said humidity sensor, said electronic controller having a processor which includes a table storing temperature settings and humidity settings representing said drying chamber temperature and humidity conditions at the beginning of a drying cycle, and midway through a drying cycle, said processor being programmed to:

compare the temperature within said drying chamber with said table stored temperatures, and to compare said humidity within said drying chamber with said table stored humidity settings;

supply an enabling signal to said control means during the beginning of said cycle to establish one of said stored temperatures for the beginning of the drying cycle, supply a second control signal to said control means for establishing a second of said stored temperatures in said drying chamber when said humidity is equal to said stored humidity for said beginning of said cycle, and supply a third control signal to said control means for establishing a third temperature in said drying chamber when said drying chamber humidity reaches said stored midway drying cycle humidity whereby a final drying temperature is established for the duration of said drying cycle.

7. The circuit for controlling drying according to claim 6 wherein said means for supplying an enabling signal disables supplying of said third control signal when said drying chamber humidity reaches a stored end of drying cycle humidity.

8. The circuit for controlling drying according to claim 7 further comprising means for initiating a cool down period following disabling of said third control signal, said means disabling rotation of said drying tumbler when said cool down period expires.

9. In a drying apparatus having a drying chamber which includes a motor driven tumbler for receiving garments to be dried, a heat source controller for establishing a drying temperature in the drying chamber, a controller circuit for controlling the heat source and the motor driven tumbler comprising:

a humidity sensor for sensing the relative humidity within said drying chamber;

a temperature sensor for sensing the temperature within said drying chamber;

a processor connected to receive signals from said temperature sensor and said humidity sensor, said processor being programmed to:

generate a sequence of enable signals for said heat source controller, the first of said enable signals establishing a first initial drying temperature, a second subsequent enable signal establishing a second drying temperature when a first predetermined humidity level is measured within said chamber, said second enable signal ending when a second predetermined humidity level is measured within said drying chamber.

10. The controller circuit according to claim 9 wherein said processor generates a cool down period following said sequence of enabling signals and disables said motor driven tumbler following said cool down period.

11. The controller circuit according to claim 9 wherein said processor generates a third successive enable signal when said second successive humidity level is measured in said drying chamber.

12. The controller circuit according to claim 10 wherein said first drying temperature is higher than said second drying temperature.

13. The controller circuit according to claim 11 wherein said second and subsequent enable signals establish a lower temperature than a previous enable signal, and begin at a relative humidity which is lower than said first humidity level.

14. The controller circuit according to claim 9 wherein said processor generates a cool down period when said humidity reaches a predetermined level less than said first predetermined level, and disables rotation of said motor driven tumbler when said cool down period expires.

15. The controller circuit according to claim 11 wherein said processor terminates said third successive enable signal when said relative humidity is below a third successive humidity.

16. The controller circuit according to claim 9 further comprising:

a second humidity sensor positioned external to said drying chamber and connected to said processor for determining an environmental relative humidity for said drying apparatus, said processor modifying said first and second humidity levels in response to said environmental relative humidity.

* * * * *